US012595906B2

(12) United States Patent
Klobucar

(10) Patent No.: US 12,595,906 B2
(45) Date of Patent: Apr. 7, 2026

(54) THERMAL REGENERATIVE FLUID PROCESSING APPARATUS

(71) Applicant: ROTOHEATER LLC, Ann Arbor, MI (US)

(72) Inventor: Joseph M. Klobucar, Ann Arbor, MI (US)

(73) Assignee: Rotoheater, LLC, Ann Arbor, MI (US)

( * ) Notice: Subject to any disclaimer, the term of this patent is extended or adjusted under 35 U.S.C. 154(b) by 68 days.

(21) Appl. No.: 18/632,688

(22) Filed: Apr. 11, 2024

(65) Prior Publication Data

US 2024/0255142 A1 Aug. 1, 2024

Related U.S. Application Data

(63) Continuation-in-part of application No. 17/736,672, filed on May 4, 2022, now Pat. No. 12,247,735.

(60) Provisional application No. 63/274,578, filed on Nov. 2, 2021.

(51) Int. Cl.
*F23G 7/07* (2006.01)
*F23G 7/06* (2006.01)

(52) U.S. Cl.
CPC ..... *F23G 7/068* (2013.01)

(58) Field of Classification Search
CPC ..... F23G 7/07; F27D 17/008; F27D 2017/007
See application file for complete search history.

(56) References Cited

U.S. PATENT DOCUMENTS 5,562,442 A * 10/1996 Wilhelm ..... F23G 7/068 110/211
5,871,349 A * 2/1999 Johnson ..... F23G 7/07 165/9
6,203,316 B1 * 3/2001 Pennington ..... F27D 17/20 432/2
7,833,010 B2 * 11/2010 Baker ..... F23G 7/068 431/31
9,958,155 B1 * 5/2018 Park ..... F23G 5/46
2011/0081277 A1 * 4/2011 Balon, Jr. ..... B01D 53/72 251/304

FOREIGN PATENT DOCUMENTS

KR 101045419 B1 * 6/2011 ..... F23L 15/02
NO 328903 B1 * 6/2010 ..... F27D 17/20
WO WO-2012070892 A2 * 5/2012 ..... F23G 7/068

* cited by examiner

*Primary Examiner* — Gregory A Wilson
(74) *Attorney, Agent, or Firm* — Bodman PLC

(57) ABSTRACT

A regenerative thermal oxidizer assembly includes a first housing member and a second housing member. The first housing member defines a regenerative portion and a combustion chamber. The second housing member defines an inlet chamber and an outlet chamber. A regenerator is disposed within the regenerative portion of the first housing member. A thermal element extends through the first housing member into the combustion chamber for providing heat to the combustion chamber for initiating combustion inside the combustion chamber. The first housing member is rotatable around a central axis relative to the second housing member for rotating the regenerator relative to the inlet chamber and the outlet chamber.

19 Claims, 9 Drawing Sheets

THERMAL REGENERATIVE FLUID PROCESSING APPARATUS

PRIOR APPLICATIONS

The present application claims priority to U.S. patent application Ser. No. 17/736,672 filed on May 4, 2022 that claims priority to U.S. Provisional Patent Application No. 63/274,578, filed on Nov. 2, 2021, the contents of which are included herein by reference.

TECHNICAL FIELD

The present invention relates generally toward a thermal regenerative fluid processing apparatus. More specifically, the present invention relates toward a compact, low cost thermal regenerative fluid processing apparatus.

BACKGROUND

Thermal oxidizers have been used to clean contaminated fluid for many years. More specifically, thermal oxidizers are used to remove impurities, such as, for example, greenhouse gases contained in gaseous waste from industrial processes. Gaseous waste from industrial processes is known to include volatile organic compounds (VOC's), methane, carbon monoxide, to name a few. Primarily, thermal oxidizers have been used only in large industrial facilities. As such, thermal oxidizers have always been built on large industrial scales to handle large volumes of contaminated fluids.

However, evolving environmental standards require flexibility in thermal oxidizers but has not been previously contemplated. For example, many smaller facilities such as, for example, dry cleaners, bakeries, and large scale farms are coming under increasing scrutiny to eliminate even small amounts of VOC's and other greenhouse gases. Available large industrial thermal oxidizers are not suited to handle small scale operations. Furthermore, not every VOC emitting facility requires a same sized oxidizer. Therefore, customized oxidizers are acquired but are even further cost prohibitive. Therefore, there is a need for a low cost, adaptable thermal oxidizer available for use in a variety of facilities.

SUMMARY

A regenerative thermal oxidizer assembly includes a first housing member and a second housing member. The first housing member defines a regenerative portion and a combustion chamber. The second housing member defining an inlet chamber and an outlet chamber. A regenerator is disposed within the regenerative portion of the first housing member. A thermal element extends through the first housing member into the combustion chamber providing heat to the combustion chamber for initiating combustion inside the combustion chamber. The first housing member is rotatable relative to the second housing member around a central axis allowing the first housing member to rotate the regenerator relative to the inlet chamber and the outlet chamber defined by the second housing member.

The unique and compact designed of the thermal oxidizer of the present invention allows for implementation of a low cost thermal oxidizer applicable to nearly any facility that generates contaminated fluids that may be oxidized to reduce greenhouse gases. Making use of the axial opening simplifies overall design and eliminates sophisticated characteristics of existing oxidizers. Simplicity of providing oxidation energy to the combustion chamber through the axial opening substantially reduces cost of manufacturing the thermal oxidizer of the present invention. In addition, the compact design of the thermal oxidizer of the present invention provides the opportunity for modular implementation in any facility eliminating the need for customized designs. As such, two, three or more oxidizers may be interconnected in parallel to accommodate larger scale facilities. For the first time oxidizing technology may be adapted for broad scale use achieving significant reductions in greenhouse gases previously not obtainable.

BRIEF DESCRIPTION OF THE DRAWINGS

Other advantages of the present invention will be readily appreciated as the same becomes better understood by reference to the following detailed description when considered in connection with the accompanied drawings, wherein.

DETAILED DESCRIPTION

Figure 1:
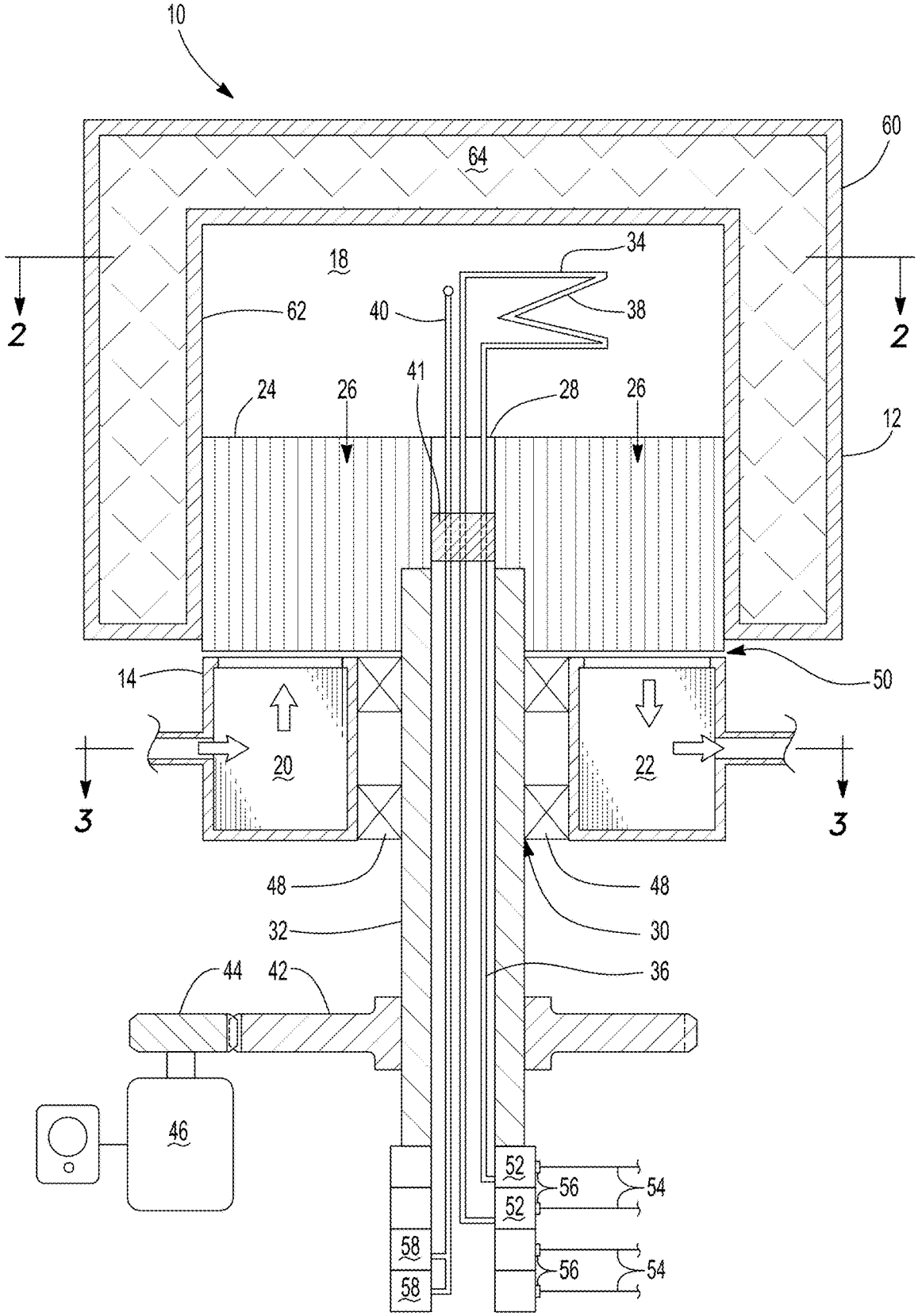
FIG. 1 shows a cross-sectional view of a regenerative thermal oxidizer of the present invention.

Referring to FIG. 1, a regenerative thermal oxidizer of the present application is generally shown at 10. The oxidizer 10 includes a first housing member 12 and a second housing member 14. The first housing member 12 defines a regenerative portion 16 and a combustion chamber 18. The second housing member 14 defines an inlet chamber 20 and an outlet chamber 22.

A regenerator 24 is disposed within the regenerative portion 16 of the first housing member 12. The regenerator 24 is formed of ceramic material defining pathways 26 that enable passage of gas between the second housing member 14 and the combustion chamber 18 defined by the first housing member 12 the purpose of which will be explained further here and below. The ceramic material from which the regenerator 24 is formed is capable of being heated by oxidation combustion occurring within the combustion chamber 18 and transferring this heat to inlet gases received from the inlet chamber 20 to improve oxidizer 10 efficiency.

The regenerator 24 defines a first housing axial opening 28 extending through to the combustion chamber 18. Likewise, the second housing member 14 defines a second housing axial opening 30 that is coaxial with the first housing axial opening 28. A tubular member 32 extends through the second housing axial opening 30 and is received by the first housing axial opening 28. Therefore, it should be understood that the tubular member 32 is axially aligned with the first housing axial opening 28 and the second housing axial opening 30.

A thermal element 34 extends through the tubular member 32 into the combustion chamber 18. In one embodiment, the thermal element 34 includes an electrical line 36 that provides electrical current to a heating coil 38 residing in the combustion chamber 18. In an alternative embodiment, the thermal element 34 includes an inlet tube that is interconnected to a source of combustible gas to direct the combustible gas to the combustion chamber 18 for providing sufficient combustion energy to the combustion chamber 18. With either an electrical or a gas thermal element 34, it is necessary for the thermal element 34 to provide enough heat energy to the combustion chamber 18 to oxidize dirty gas entering the combustion chamber 18 via the inlet chamber 20. A temperature probe 40 also extends through the tubular member 40 into the combustion chamber 18 to monitor temperature inside the combustion chamber 18. A seal 41 or grommet is disposed within the tubular member 40 to prevent escape of gas from the combustion chamber 18. Openings are defined in the seal 41 to allow the thermal element electrical line 36 and the temperature probe 40 to pass through to the combustion chamber 18.

The tubular member 32 includes a drive element 42 that engages a driver 44. The driver 44 translate rotary movement from a drive motor 46 to the drive element 42 for rotating the tubular member 32 around a pivot axis. The tubular member 32 is affixed to the first housing member 12 in a manner that translates rotational movement to the first housing member 12 from the driver 44.

A plurality of bearings 48 are disposed between the second housing member 14 and the tubular member 32 inside the second axial opening 30 that allows the tubular member 32 to rotate without translating rotational movement to the second housing member 14. Therefore, it should be understood that the first housing member 12 rotates around a pivot axis defined by the tubular member 32 while the second housing member 14 remains in a stationary disposition. Furthermore, the second housing member 14 is separated from the regenerator 24, and therefore the first housing member 14 by a space 50 to prevent any rotational moment being transferred from the rotating first housing member 12 to the stationary second housing member 14.

A first conductor 52 is integral with the tubular member 32 so that the conductor 52 rotates with the tubular member 32. The conductor 52 receives electrical current from electric line 54 via a first conductive leaf 56 that is in contact with the first conductor 52 but remains in a stationary position relative to the rotating conductor 52. The electric line 36 is fixedly attached to the first conductor 52 so that the first conductor 52 provides electric current through the thermal element electric line 36 to the thermal element 34. Therefore, it should be understood that the thermal element 34 rotates with the tubular member 32. Likewise, the temperature probe 40 is fixedly attached to a second conductor 58 that receives electric current from electric line 54 via a conductive leaf 56. Thus, the temperature probe 40 also rotates with the tubular member 32. The thermal element electric line 36 transfers sufficient electrical energy from the conductor 52 to the thermal element 34 for providing oxidation energy to the combustion chamber 18 defined by the first housing member 12. As explained above, the first housing member 12 rotates with the tubular member 32 along with the thermal element 34 and the temperature probe 40 while the second housing member 12 remains stationary.

Figure 2:
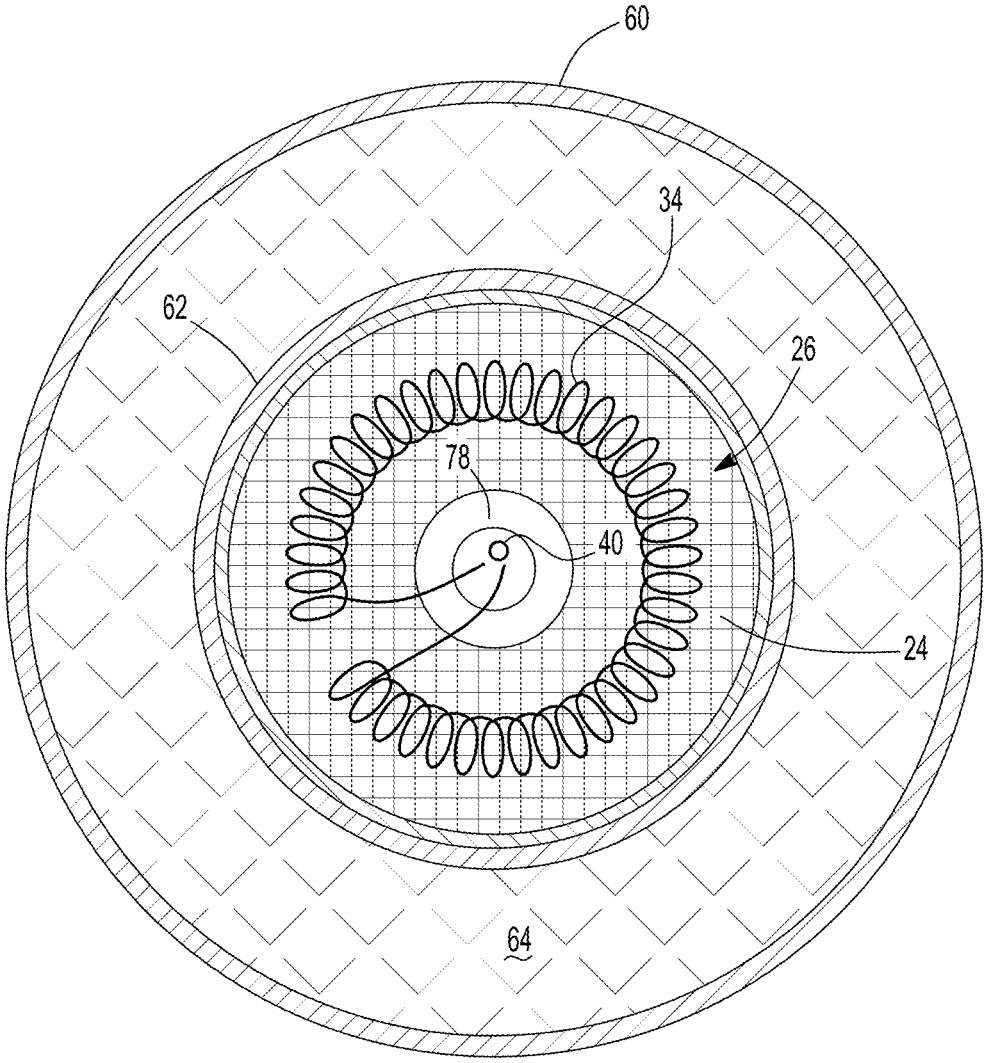
FIG. 2 shows a cross-sectional view of the combustion chamber through line 2-2 of FIG. 1.

Referring now to FIG. 2, a sectional view through line 2-2 of FIG. 1 is shown. The thermal element 34 disposed within the combustion chamber 18 takes the form of a coil that substantially circumscribes the first axial opening 28 defined by the regenerator 24. In this embodiment, that regenerator 24 defines axial passages 26 extending from the combustion chamber 18 to the space 50 that separates the second housing member 14 from the regenerator 24 as is set forth above.

The first housing member 12 defines in outer annular wall 60 that circumscribes an inner annular wall 62 so that the combustion chamber 18 is enclosed within the inner annular wall 62. In insulator 64 is disposed between the inner and outer wall 62 and the outer and inner wall 60 to contain the oxidation heat within the combustion chamber 18. In addition, the insulator 64 reduces an amount of heat that reaches the outer annual wall 60 to prevent heat radiating from the outer annular wall 60.

Figure 3:
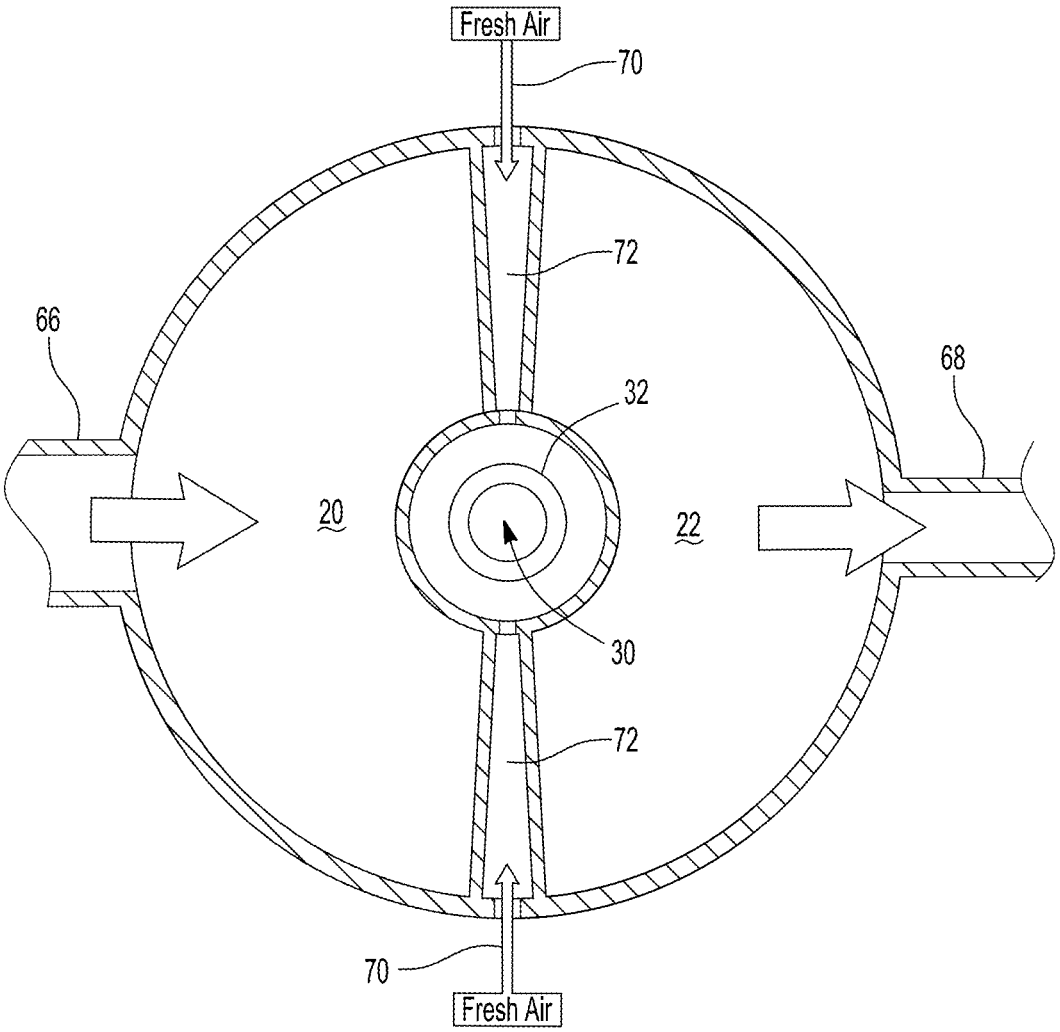
FIG. 3 shows a cross-sectional view of a second housing through line 3-3 of FIG. 1.

Referring now to FIG. 3, a sectional view of the second housing member 14 through line 3-3 of FIG. 1 is shown. An inlet conduit 66 delivers contaminated gases into the inlet chamber 20 defined by the second housing member 14. Likewise, an outlet conduit 68 is fluidly connected to the outlet chamber 22 to transfer oxidized, clean gases outwardly from the second housing member 14. The second housing member 14 also defines opposing fresh air inlet chambers 72 that separate the inlet chamber 20 from the outlet chamber 22. Fresh air is delivered to the fresh air inlet chambers 72 through fresh air inlets 70.

In one embodiment a pump or a fan establish a negative pressure within the outlet conduit 68 that in turn establishes a negative pressure within the combustion chamber 18. Generating a negative pressure in this manner assists gaseous flow through the oxidizer 10 and by drawing gasses into the combustion chamber 18 from the inlet chamber 20. It is also contemplated that the pump or fan generates enough pressure to prevent gasses from escaping though the space 50 disposed between the first housing member 12 and the second housing member 14.

It should be evident that relative position of any of the inlet chamber 20, outlet chamber 22, and fresh air inlet chamber 68 change with respect to the regenerator 24. Therefore, different portions of the regenerator 24 continuously receive inlet gases due to alignment with the inlet chamber 20 while opposite portions of the regenerator 24 transfer outlet gases from the combustion chamber 18 to the outlet chamber 22. Due to rotation, that portion of the regenerator 24 that was formerly emitting contaminated gases to the combustion chamber 18 rotates through the fresh air inlet chamber 72 for evacuating clean gasses to the outlet chamber 22. Thus, by rotating that portion of the regenerator that was previously heated by the clean gasses exiting combustion chamber 18 to an orientation for receiving contaminate gas from the inlet chamber 20, the contaminated gases are preheated and energy requirements to achieve oxidation reactions inside the combustion chamber 18 are reduced.

Figure 4:
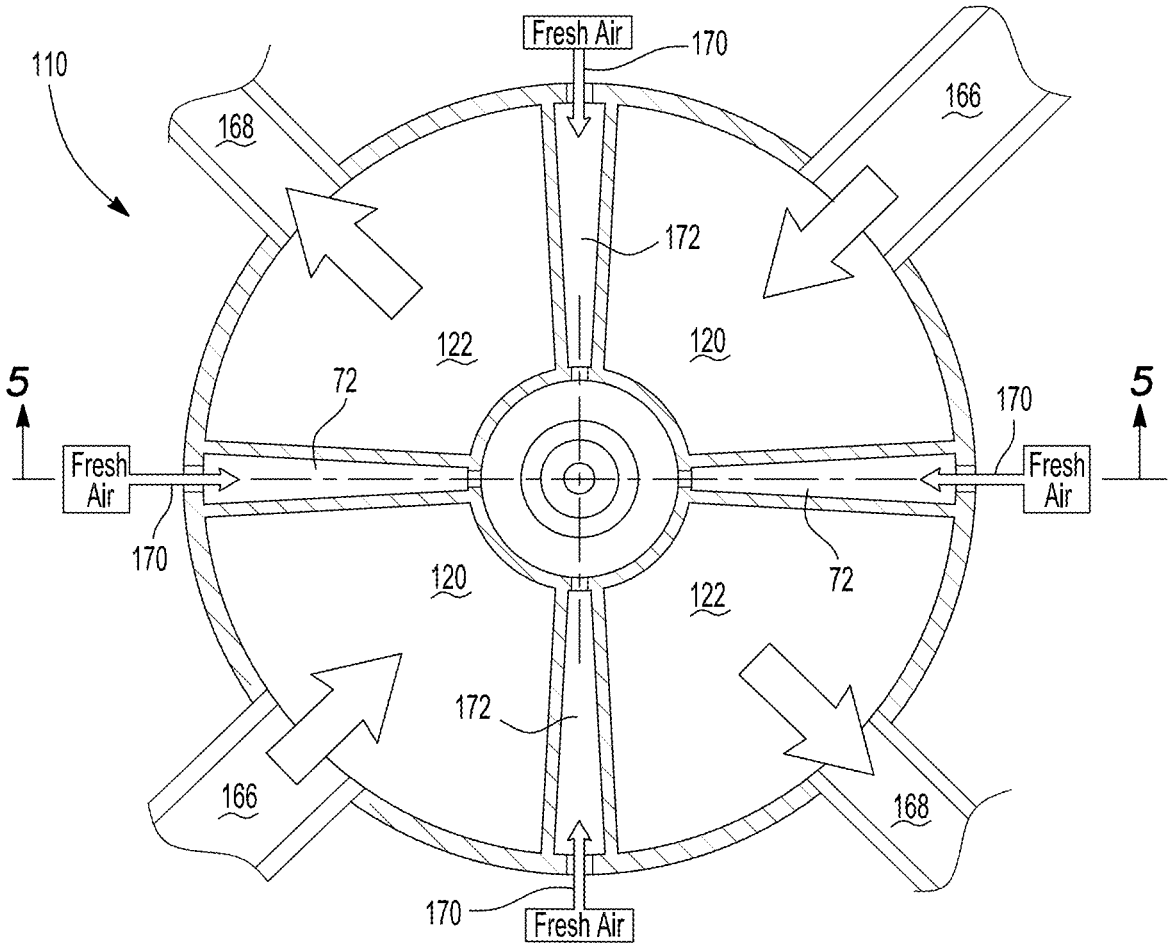
FIG. 4 shows a cross-sectional view of an alternative embodiment of the second housing.
Figure 5:
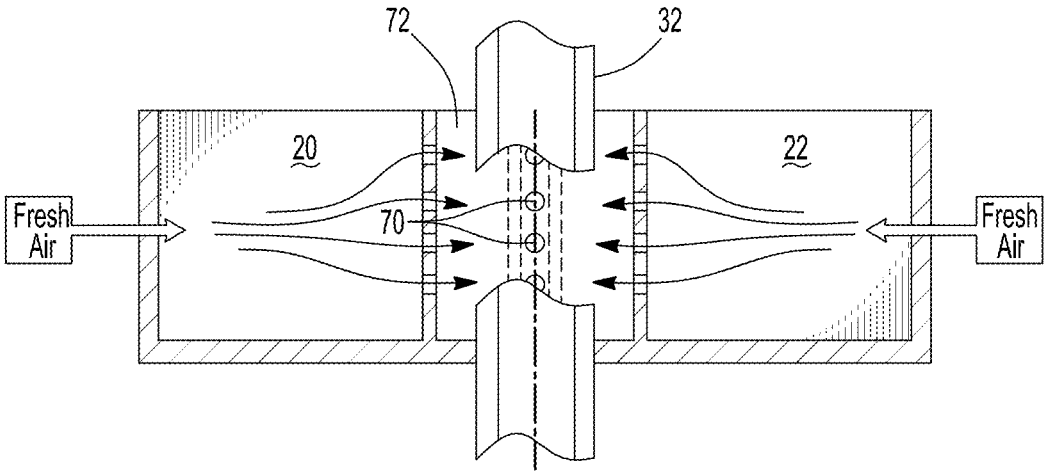
FIG. 5 shows a cross-sectional view of the second housing through line 5-5 of FIG. 4.

An additional embodiment is generally shown at 110 of FIG. 4 wherein like element numbers of the earlier embodiment are identified with the same element numbers but in the 100 series. For further adjustments in flowrates into and out of the combustion chamber 18, the first housing member 112 may be reconfigured to provide opposing inlet chambers 120 separated by opposing outlet chambers 122. As such, each inlet chamber 120 includes an individual inlet conduit 166 and each outlet chamber 122 includes an individual outlet conduit 168. As is in the prior embodiment, each inlet chamber 120 is separated from each outlet chamber 122 by a fresh air inlet chamber 172 to provide purge gas to the regenerator 124. Therefore, four fresh air inlet chambers 172 are included in this embodiment, each receiving fresh air via a fresh air inlet 170. Otherwise, this second embodiment functions in the same manner as the first embodiment, but with more frequent passes of the regenerator 24 over inlet in outlet chambers 120, 122.

It is within the scope of this invention that a plurality of oxidizers 10 may be interconnected to increase cleaning potential for operations that may require higher rate of oxidation then a single oxidizer 10 may provide. Referring two FIGS. 6 and 7, a plurality of oxidizers is shown enclosed within a housing 74. The housing 74 defines a common contaminated gas inlet 76 and a common clean gas outlet 78. This configuration interconnects each oxidizer 10 in parallel as will be explained further hereinbelow.

Figure 6:
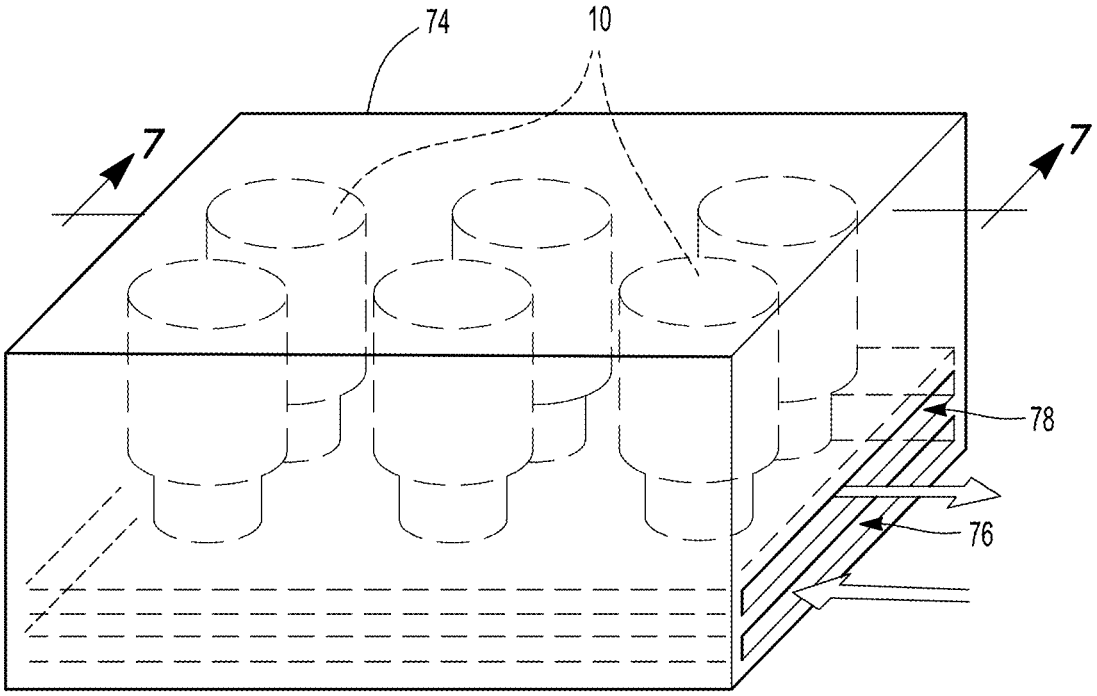
FIG. 6 shows a perspective view of a modular design of a plurality of cooperable thermal oxidizers.
Figure 7:
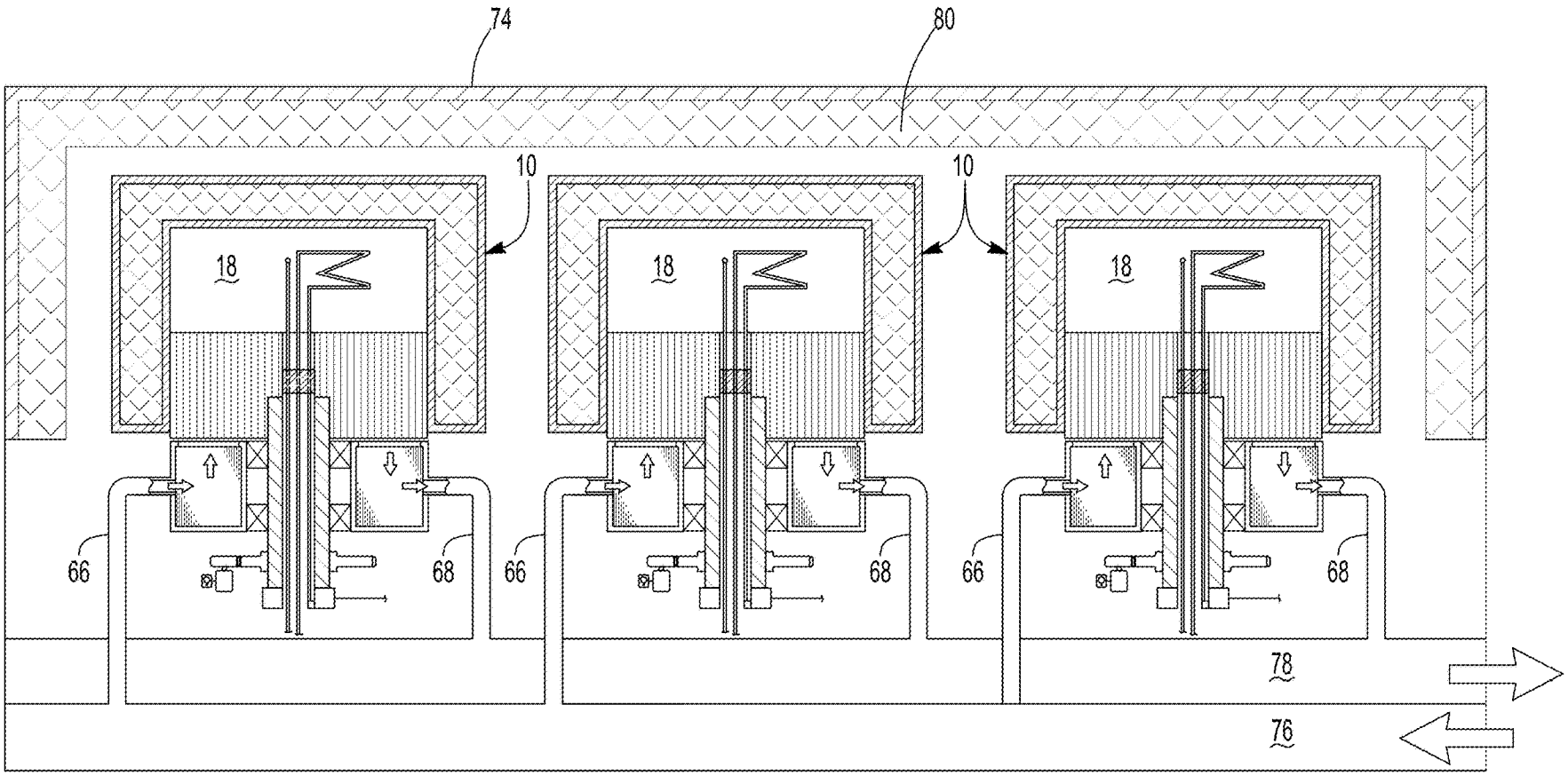
FIG. 7 shows a side cross-sectional view of the modular system of the plurality of cooperable thermal oxidizers through line 7-7 of FIG. 6.

Differing now to FIG. 7, a cross sectional view through line 7-7 of FIG. 6 will now be explained. In this embodiment, the oxidizer 10 are arranged in parallel. Therefore, The inlet conduit 66 of each oxidizer 10 is fluidly connected to the common inlet 76. Likewise, the outlet conduit 68 of each oxidizer 10 is fluidly connected to the common outlet 78. A diameter of each inlet conduit 66 in each outlet conduit 68 may be adjusted too control flow rate of the various gases entering and exiting each oxidizer 10. Alternatively, valves may be implemented to balance flow rate into and out of each oxidizer 10. The housing 74 may also include housing insulation 80 to further reduce loss of heat from the combustion chamber 18 of each oxidizer 10.

It should be understood that while six oxidizers 10 are shown in this embodiment, more or less oxidizers 10 may be included for particular purpose. Further, a facility may add additional oxidizers 10 or modules that include a plurality of oxidizers 10 when VOC output is increased requiring additional abatement. Thus, low cost economical oxidizer 10 of the present invention provides a fully modular solution enabling reduction of greenhouse gases but previously achievable of small facilities.

Figure 8:
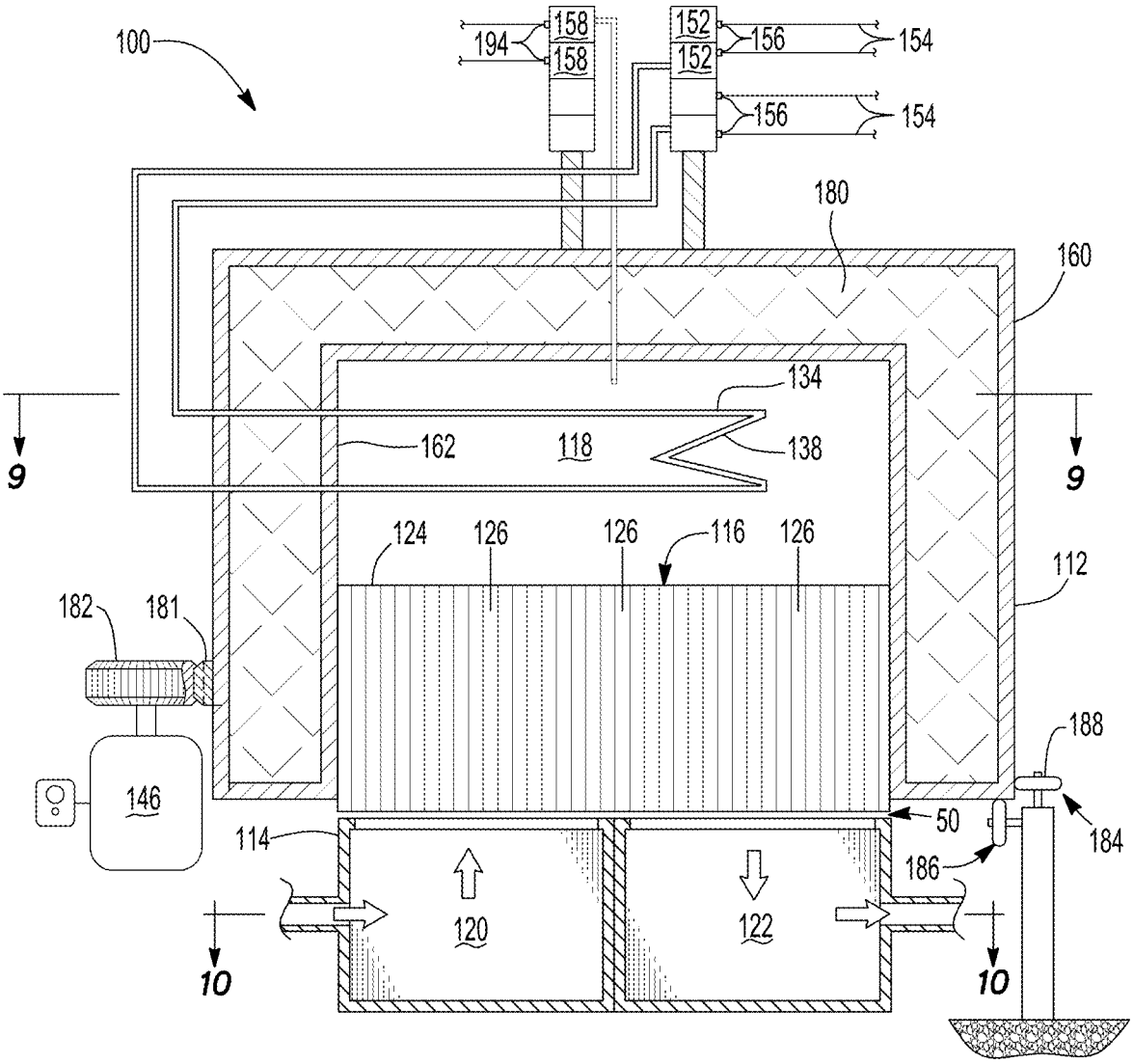
FIG. 8 shows a cross-sectional view of an alternative regenerative thermal oxidizer of the present invention.
Figure 9:
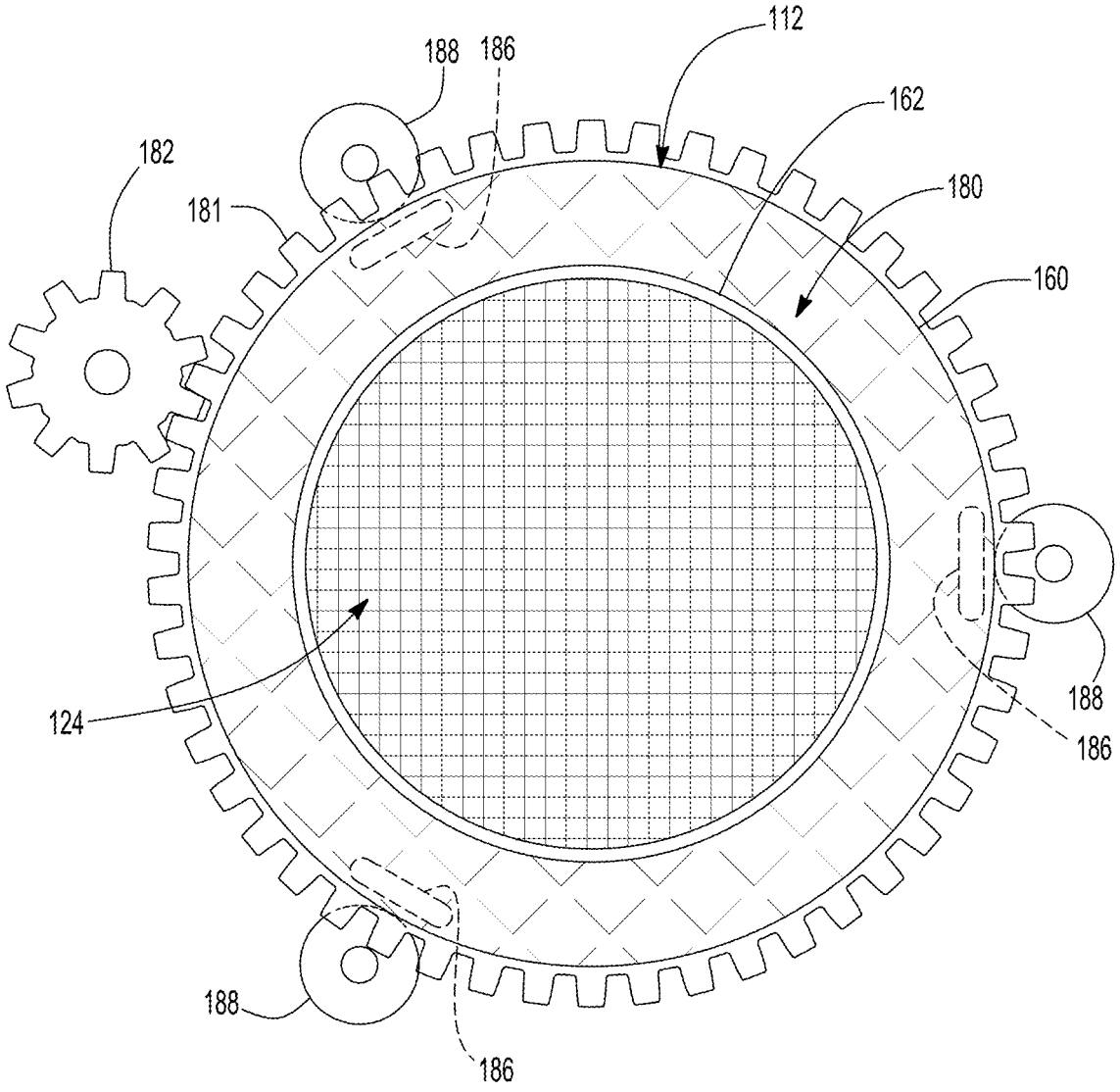
FIG. 9 shows a cross-sectional view of a second housing through line 9-9 of FIG. 1.
Figure 10:
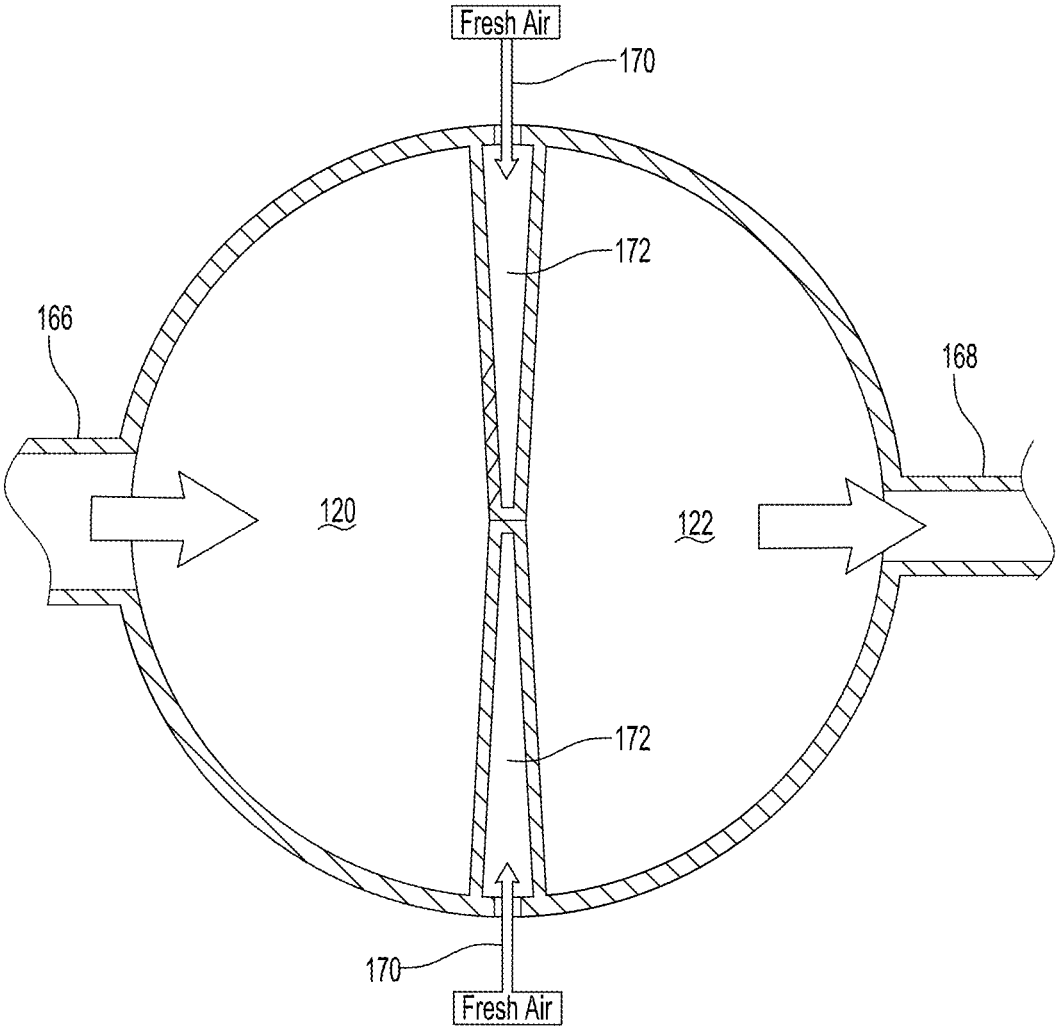
FIG. 10 shows a cross-sectional view of an alternative second housing through line 10-10 of FIG. 1.

An alternative embodiment of the invention of the present application is shown in FIGS. 8, 9 and 10 where like elements of the earlier embodiment include same element numbers but in the 100 series. For brevity, these elements will not be described again. However, it should be understood that these elements are interchangeable with each embodiment.

Referring now to FIG. 8, the alternative embodiment is generally shown at 100. The alternate assembly 100 includes a first housing member 112 and a second housing member 114. The first housing member 112 defines an outer annular wall 160 and an inner annular wall 162.

Insulation 180 is disposed between that inner outer annular wall 160 and the inner annular wall 162. In one embodiment the insulation 180 is microporous. The microporous insulation 180 provides extremely low thermal conductivity in a broad temperature range. Microporous insulation 180 such as, for example, pyrogenic silica powder also referred to as fumed silica and opacifiers in the form of a pourable powder is implemented. The microporous insulation may contain opacifiers to reduce radiant heat from being transmitted within the insulation. The microporous insulation, in one embodiment, includes an average interconnecting pore size comparable to or below a mean free path of air molecules or between 64-68 nm. The light weight of the microporous insulation will reduce the physical load on the drive mechanism 46, 146 and the rotary elements 184. However, it should be understood by those of ordinary skill in the art that other lightweight insulation is also within the scope of this invention.

The outer annular wall 160 is circumscribed by a ring gear 181. The ring gear 181 is engaged with a spider gear 182 or equivalent driving gear that receives rotary movement by a drive motor 146. While "spider gear" and "ring gear" is used throughout the specification it should be understood that alternative drive mechanisms may be implemented to translate rotary movement to the first housing member 112. This may include driving one or more vertical support wheel 186 or horizontal support wheel 188.

The first housing member 112 is pivotably supported by support elements 184. In one embodiment the support element 184 includes the vertical support 186 and the horizontal support 188. In another embodiment a plurality of rotary elements 184 are spaced around the first housing member 112. The vertical support 186 includes a vertical support wheel and the horizontal support 188 includes a horizontal support wheel. Alternative supports 186, 188 including low friction stationary non-pivoting supports are within the scope of this invention.

In the alternate embodiment 100 a thermal element 134 extends through the first housing member 112 into the combustion chamber 118. Therefore, the thermal element 134 rotates with first housing member 112. In a same manner as the first embodiment, the thermal element 134 includes an electrical line 154 and an electrical heating coil 138 to convert electrical energy into thermal energy within the combustion chamber 118. Electrical current is received by the electrical line 154 from a conductor 152 via a conductive leaf 156. The conductor 152 receive electrical current through a conventional electrical line 154 in a known manner. In this embodiment, the conductor 152 pivots with the first housing member 112 while remaining in constant electrical contact with the leaf 156 that remains stationary. It should be understood that an opposite arrangement in which the leaf 156 pivots with the first housing member 112 while the conductor 152 remains stationary is also within the scope of this invention.

A temperature probe 140 extends through the first housing member 112 into the combustion chamber 118 and is electronically connected a second conductor 158. The second conductor 158 pivots with the first housing member 112. Thus, a probe leaf 194 provides electronic connection to a thermal controller to monitor and adjust temperature within the combustion chamber 118.

An alternative regenerator 124 is disposed within the regenerative portion 116 of the first housing member 112. The alternative regenerator 124 is formed of ceramic material defining pathways 126 that enable passage of gas between the second housing member 114 and the combustion chamber 118 defined by the first housing member 112 and functions in a same manner as does the first embodiment. The ceramic material from which the regenerator 124 is formed is capable of being heated by oxidation combustion occurring within the combustion chamber 118 and transferring this heat to inlet gases received from the inlet chamber 120 to improve oxidizer 110 efficiency. Unlike the first embodiment that defines an axial opening, the regenerator 124 presents a continuous upper surface within the combustion chamber 118. The regenerator 124 rotates with the first housing member 112.

The second housing member 114 is stationary relative to the first housing member 112 and defines an inlet chamber 120 and an outlet chamber 122 that function in a same manner as the first embodiment. Thus, the inlet chamber 120 deliver dirty or contaminated gasses to the combustion chamber 118 and evacuates cleaned gas through the outlet chamber 122. Fresh air inlet chambers 172 are disposed between the inlet chamber 120 and the outlet chamber 122 functioning in a same manner as the first embodiment. Rotation of the first housing member 112 relative to the second housing member 114 continuously changes the location the inlet chamber 120, the outlet chamber 122 and the fresh air inlet chambers 172 relative to the regenerator 126 also in a same manner as the first embodiment.

The invention has been described in an illustrative manner; many modifications and variations of the present invention are possible. It is therefore to be understood that within the specification, the reference numerals are merely for convenience, and are not to be in any way limiting, and that the invention may be practiced otherwise than is specifically described. Therefore, the invention can be practiced otherwise than is specifically described within the scope of the stated claims following this first disclosed embodiment.

What is claimed is:

1. A regenerative thermal oxidizer assembly, comprising:

a first housing member and a second housing member;

said first housing member defining a regenerative portion and a combustion chamber;

said second housing member defining an inlet chamber and an outlet chamber;

a regenerator being disposed within said regenerative portion of said first housing member;

a thermal element extending into said combustion chamber providing heat to said combustion chamber for initiating combustion inside said combustion chamber;

a drive motor being drivably engaged with said first housing member for pivoting said first housing member relative to said second housing member thereby continuously pivoting said regenerator relative to said inlet chamber and said outlet chamber; and rotatable around an axis defined by said axial opening relative to said second housing member thereby rotating said regenerator relative to said inlet chamber and said outlet chamber defined by said second housing member.

2. The assembly set forth in claim 1, wherein said first housing member includes a ring gear disposed upon an outer surface thereof and said drive motor includes a worm gear being in driving engagement with said ring gear thereby providing pivotal motion to said first housing member.

3. The assembly set forth in claim 2, wherein said thermal insulator comprises a microporous insulator defining an average interconnecting pore size below an average free path size of air molecules.

4. The assembly set forth in claim 2, wherein said microporous insulator comprises a at least one of pyrogenic silica powder and opacifiers.

5. The assembly set forth in claim 2, wherein said thermal element is an electrical element receiving electrical current through a conductor slidably engaged with a conductive leaf for transferring electrical energy from a source of electrical energy to said thermal element.

6. The assembly set forth in claim 1, wherein one or more support wheels are in driving engagement with said drive motor thereby providing pivotal motion to said first housing member.

7. The assembly set forth in claim 1, wherein said first housing member defines an outer annular wall and an inner annular wall including a thermal insulator disposed therebetween.

8. The assembly set forth in claim 1, wherein said thermal element extends into said combustion chamber through said first housing member.

9. The assembly set forth in claim 1, wherein said second housing member defines a purge chamber disposed between said inlet chamber and said outlet chamber for providing purge gas to said regenerator.

10. The assembly set forth in claim 1, wherein said first housing member is rotatably supported by a rotary element.

11. The assembly set forth in claim 10, wherein said rotary element includes a vertical support and a horizontal support.

12. The assembly set forth in claim 1, wherein said second housing member defines a seal compartment including a seal disposed therein for sealing said first housing to said second housing.

13. The assembly set forth in claim 12, wherein said seal comprises a sealing fluid provided to said seal compartment by a source of seal fluid.

14. The assembly set forth in claim 1, wherein said first housing is spaced from said second housing member.

15. The assembly set forth in claim 1, wherein said combustion chamber includes a negative pressure being below atmospheric pressure.

16. The assembly set forth in claim 15, wherein said outlet chamber is fluidly connect to one of a pump and a fan for generating negative pressure inside said outlet chamber and said first housing member.

17. The assembly set forth in claim 1, further including a temperature sensor disposed within said combustion chamber for regulating electrical current to said thermal element.

18. The assembly set forth in claim 1, wherein a plurality of assemblies are interconnected though a common inlet.

19. The assembly set forth in claim 18, wherein said plurality of assemblies are disposed within a housing that defines the common inlet.

* * * * *